United States Patent [19]

Newcombe-Bond

[11] Patent Number: 4,889,622

[45] Date of Patent: Dec. 26, 1989

[54] SWIMMING POOL SKIMMER

[75] Inventor: William J. Newcombe-Bond, Durban, South Africa

[73] Assignee: Graham Mervyn Elliott, Durban, South Africa

[21] Appl. No.: 239,230

[22] Filed: Sep. 1, 1988

[51] Int. Cl.[4] ..... E04H 3/20

[52] U.S. Cl. ..... 210/169; 210/242.1; 4/490; 134/167 R; 15/1.7

[58] Field of Search ..... 210/169, 242.1; 4/490; 15/1.7; 134/167 R

[56] References Cited

U.S. PATENT DOCUMENTS

| | | | |
|---|---|---|---|
| 3,229,315 | 1/1966 | Watson | 15/1.7 |
| 3,860,518 | 1/1975 | Henricksen | 15/1.7 |
| 3,928,202 | 12/1975 | Raubenheimer | 15/1.7 |
| 4,040,864 | 8/1977 | Steeves | 15/1.7 |
| 4,105,557 | 8/1978 | Weatherholt | 15/1.7 |

*Primary Examiner*—W. Gary Jones
*Assistant Examiner*—Coreen Y. Lee
*Attorney, Agent, or Firm*—Myers & Ehrlich, Ltd.

[57] ABSTRACT

The invention relates to a skimmer for swimming pools which includes a float having an opening for receiving debris on the surface of the pool, and a mesh rearwardly of the opening for catching the debris, the float being connected by a line to the pipe of an automatic suction cleaner near the suction cleaner for the float to be dragged behind the suction cleaner.

1 Claim, 1 Drawing Sheet

FIG. 1
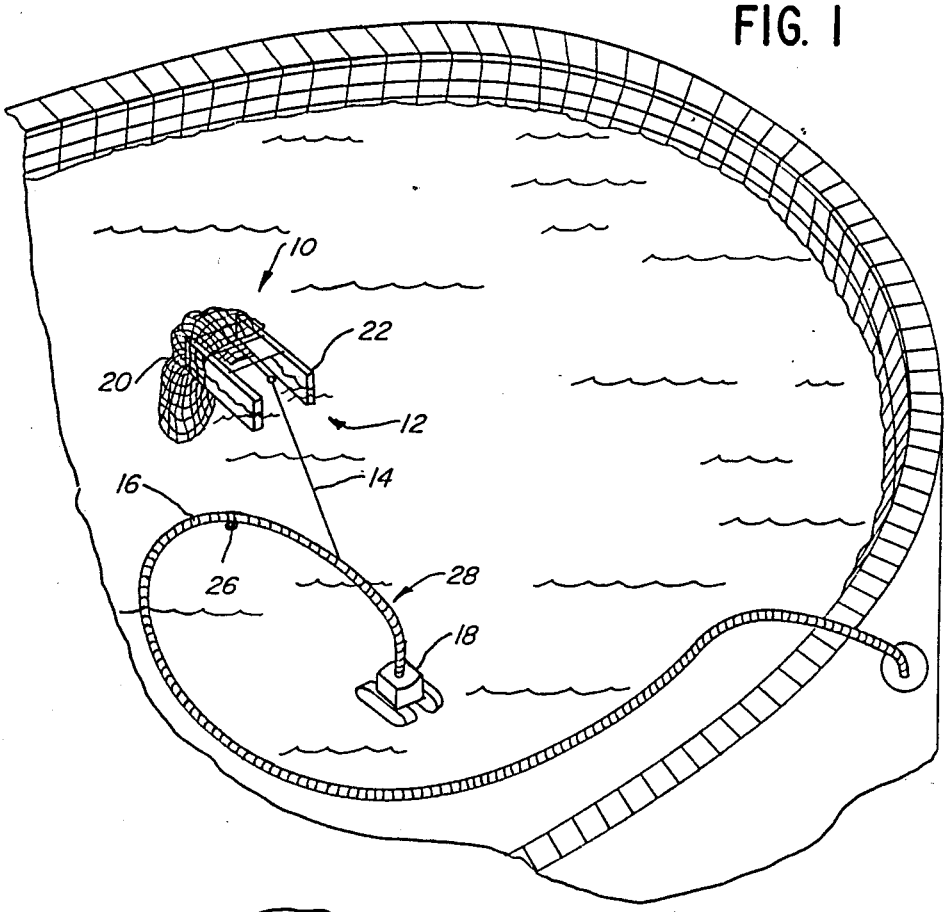
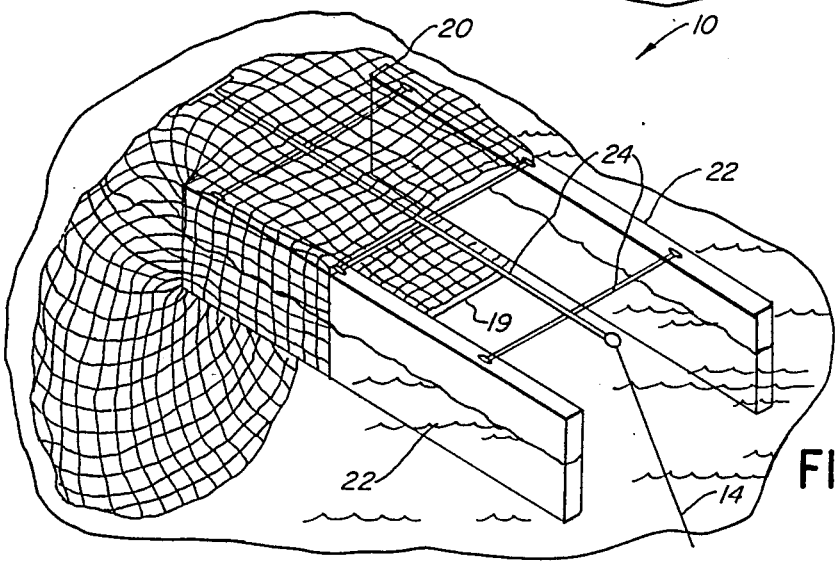
FIG. 2

SWIMMING POOL SKIMMER

FIELD OF THE INVENTION

This invention relates to a swimming pool skimmer.

BACKGROUND OF THE INVENTION

The advent of the automatic swimming pool suction cleaners has greatly alleviated the drudgery of maintaining pools. One of the main problems remaining is that due to floating objects such as leave and other vegetable matter and it is an object of the present invention to provide an automatic device for maintaining the surface of the pool free from floating matter.

THE INVENTION

According to the invention there is provided float which has an entrance at the water surface, means to retain material entering the float and a line connecting the float to the pipe of an automatic suction cleaner.

The length of line is chosen so that it plus the distance of its connection from the suction cleaner corresponds approximately to the maximum depth of the swimming pool to ensure that the pipe does not drag the float downwardly when the automatic cleaner moves to deep water and, of course, also to ensure that the float does not prevent the head of the cleaner from travelling in its usual free course.

It may be necessary to add a mass to the pipe rearwardly of the connection of the line in order to keep the pipe away from the float and thereby prevent fouling of the float and the pipe.

In a preferred form of the invention a pair of floats are provided which are joined with cross members on their top surfaces, and a mesh bag having an opening of a size for slipping over the arrangement being located rearwardly to be free to drag behind the floats. The lower edge of the bag is preferably weighted so that it remains below the surface of the water.

The line may be wholly or partially elastic to accommodate variations of depth of the pool.

The float of the invention may comprise a simple plastic body or pair of associated plastic bodies which support a mesh bag rearwardly thereof for catching and collecting floating debris which enters the float during its passage hither and thither across the pool surface in the wake of the suction cleaner.

EMBODIMENT OF THE INVENTION

An embodiment of the invention is described below with reference to the accompanying drawings, in which:

FIG. 1 is a view of a corner of a pool with a skimmer according to the invention connected to the pipe of an automatic suction cleaner;

FIG. 2 is an isometric view of the skimmer as shown in FIG. 1.

Referring firstly to FIG. 2, a skimmer 10 includes a pair of floats 22 made from a polymeric material such a polyolefin, maintained apart by metal or plastic rods 24, and a mesh bag 20 is slipped over the floats to hang behind them and to catch and retain floating debris which enters the float.

The lower edge 19 of the bag may include a weight (not shown) to maintain it below the level of the water. It will be appreciated that the overall density of the skimmer is just about unity so that the lower edge of the bag 19 is below the level of the water. However, the density may be less than unity and the edge 19 of the bag may be submerged by providing a downwardly-depending structure over which the edge is located.

A line 14 (which may be wholly or partially elastic) connects the skimmer 10 to the pipe 16 of an automatic suction cleaner 18, the length of the line 14 and the distance 28 of the connection to the suction cleaner being approximately the greatest depth of the pool. However, if a substantial portion of the line is elastic or elasticised, the skimmer will not be drawn downwards by the suction cleaner when it is at the greatest depth. The line 14 is connected to the skimmer at a high position as shown in FIG. 2 so that it does not prevent ingress of floating debris.

A mass 26 is provided rearwardly of the connection so that the pipe does not foul with the skimmer.

I claim:

1. A towed swimming pool skimmer in combination with a submerged automatic suction pool cleaner comprising a pair of floatable laterally spaced elongated elements arranged in spaced apart parallel relation and defining a channel therebetween defining a forward open inlet for receiving debris floating in the pool attendant to the skimmer being towed across the pool, said skimmer having a rear outlet, a skeletal frame having rods extending transverse of the elements for holding them apart and attached thereto, a fore and aft extending rod connected to said transversely extending rods providing a towing line attachment structure, a line connecting said attachment structure and a pipe of said pool cleaner, and a mesh collector bag slipped over said elements located rearwardly at said outlet for collecting the debris passing in the channel through said outlet.

* * * * *